US005569103A

United States Patent [19]

Sihn

[11] Patent Number: 5,569,103

[45] Date of Patent: Oct. 29, 1996

[54] GOLF BALL MARKER

[76] Inventor: Sang C. Sihn, 1564 Bristol Pike, Bensalem, Pa. 19020

[21] Appl. No.: 614,182

[22] Filed: Mar. 12, 1996

[51] Int. Cl.[6] ..... A63B 57/00

[52] U.S. Cl. ..... 473/406

[58] Field of Search ..... 473/406, 408, 473/401, 387; 24/114.9

[56] References Cited

U.S. PATENT DOCUMENTS

| | | | |
|---|---|---|---|
| D. 319,862 | 9/1991 | Lahger . | |
| D. 348,402 | 7/1994 | McDonald . | |
| 513,312 | 1/1894 | Esser | 24/114.9 |
| 3,087,215 | 4/1963 | Tworek et al. | 24/114.9 |
| 3,139,690 | 7/1964 | Hait . | |
| 3,556,364 | 1/1971 | Maretka | 473/408 |
| 3,622,157 | 11/1971 | Hatch | 473/408 |
| 3,895,797 | 7/1975 | Moore . | |
| 3,938,805 | 2/1976 | Sakuma . | |
| 4,521,018 | 6/1985 | Cotchonis . | |
| 4,672,718 | 6/1987 | Schlueter et al. | 24/114.9 |
| 4,822,052 | 4/1989 | Dimmick et al. . | |
| 5,054,777 | 10/1991 | Borden et al. | 473/408 |
| 5,282,616 | 2/1994 | Stacavich-Notaro . | |

FOREIGN PATENT DOCUMENTS

| | | | |
|---|---|---|---|
| 2645756 | 10/1980 | France . | |
| 664172 | 1/1952 | United Kingdom . | |
| 1043683 | 9/1966 | United Kingdom | 273/162 D |
| 2049438 | 12/1980 | United Kingdom . | |

*Primary Examiner*—Steven Wong
*Attorney, Agent, or Firm*—Richard C. Litman

[57] ABSTRACT

The present golf ball marker is removably placed upon a golf green or the like to indicate the position of a ball temporarily removed from play. The marker is preferably formed entirely of a precious metal, such as ten to eighteen karat gold, and may include one or more settings of precious stones on the upper surface thereof. Alternatively, the marker may be formed primarily of a less costly base metal and plated with a precious metal, as desired. The upper periphery preferably includes a plurality of facets therearound, with the precious metal and stones and the faceted edge providing a brilliant and highly reflective marker from virtually any angle or position, to enable the golfer to locate the marker readily when the ball is to be put back into play. The upper surface of the marker may be highly polished, or may alternatively have a florentine or brushed finish, with or without relief, engraved, or otherwise formed identification markings thereon, as desired. The substantially spherical protrusion extending from the bottom surface serves to secure the marker on the green, and also serves to secure the marker to an article of apparel as an ornamental jewelry article when not in use as a ball marker. The use of precious or noble metals provides excellent durability for the present marker, as such materials are highly resistant to the chemicals commonly used on golf greens, and serve to preclude corrosion of the marker from exposure to such chemicals.

20 Claims, 2 Drawing Sheets

GOLF BALL MARKER

BACKGROUND OF THE INVENTION

1. Field of the Invention

The present invention relates generally to sports equipment, and more particularly to golfing accessories. The present invention is a ball marker adapted for temporary and removable placement on a golf green to mark the location of a temporarily removed ball which might otherwise interfere with the path of another ball in play. The present marker includes various decorative and ornamental features which also provide various functional advantages in durability, visibility, etc.

2. Description of the Prior Art

As the rules governing the game of golf have developed, it has become the practice in most instances to allow a player whose ball lies farthest from the hole on the green, to putt first. Oftentimes, another player's ball may lie on, or very nearly on, the expected path of the farthest ball. Accordingly, the rules of the game provide for the closer player to mark the location of his/her ball temporarily, with a marker that will not impede the travel of another ball if that other ball passes over the marker.

Most players merely place a dime or other small, flat object (button, etc.) at the location of the temporarily removed ball, to mark its location until it is placed back into play at the proper turn. However, the golfing industry has developed numerous specialized markers for such use, and many players utilize such special purpose markers or some suitable object of particular monetary and/or emotional value to them (rare coin, etc.).

These various devices, either developed particularly for the purpose or adapted from other articles, lack various advantages of the present marker invention. One of the greatest problems with such devices is the difficulty in readily seeing and finding the marker when the ball is to be replaced, as generally the present markers are not of particularly high visibility. Moreover, players in a group who may have occasion to place two or more markers down at the same time, may have some difficulty in determining which marker was placed by which player, where common coins or readily available commercial plastic markers are used, as they may all have the same appearance. Also, less expensive markers are often made of metals which may be prone to corrosion, and generally provide no means for attachment to an article of clothing (wrist closure of a glove, lapel buttonhole, etc.). The present marker invention overcomes these deficiencies of the prior art with a marker which is not only of significant value to its owner as a result of the materials incorporated therein, but which also provides superior durability, high visibility, and other advantages over the prior art discussed below.

U.S. Pat. No. 3,139,690 issued to Miriam L. Hait on Jul. 7, 1964 describes a Golfing Aid comprising a multiple piece magnetic assembly. A garment attachable component includes a pin and magnetic base, and a ball marker component comprises a magnetically attractive disc. While the use of stainless steel is disclosed for corrosion resistance, the device does not provide particularly high visibility, as is provided by the present marker from virtually any angle. Moreover, the Hait marker does not include any depending protrusion to engage the surface of the green, and may thus be easily moved from its resting place by another golfer inadvertently stepping on it or by the travel of a golf ball thereover. The protrusion of the present marker provides reasonable security, and also provides for the attachment of the marker to clothing.

U.S. Pat. No. 3,895,797 issued to Harrington Moore on Jul. 22, 1975 describes a Golf Ball Marker comprising a small disc with a green engaging peg extending from one side thereof, and a wooly textured fabric material (e.g., Velcro, tm) on the opposite side thereof. The purpose is to provide a texture which reasonably resembles that of the green, in order to avoid any unnatural disruption of the ball should the ball roll over the marker. As a result, the Moore marker is difficult to see, and in fact Moore specifically states that his marker should be unobtrusive in order to avoid distracting the putting golfer. This is unlikely to be a significant distraction, as the golfer is concentrating on the ball and on the hole, rather than on other points, and markers are customarily of relatively small size, e.g., half inch diameter.

U.S. Pat. No. 3,938,805 issued to Kei Sakuma on Feb. 17, 1976 describes a Golf Accessory comprising a ball marker and attachment means therefor. The attachment means is adhesively secured to another article (the end of a putter, an article of clothing, etc.) and the marker is removably secured thereto by hook and loop material (Velcro, tm). The Sakuma marker is adapted to be placed upon the green with the hook and loop fastening material disposed downwardly, as the marker may include some form of upwardly facing identification means. However, due to the essentially planar configuration of the two Velcro attachment components, no green engaging protrusion is provided by Sakuma. Thus, the Sakuma marker may be easily dislodged from its resting place, as in the case of the Hait marker discussed further above.

U.S. Pat. No. 4,521,018 issued to N. Eugene Cotchonis on Jun. 4, 1985 describes a Golf Ball Position Marker essentially comprising a C shape, with a central open area slightly larger than the diameter of a golf ball. The Cotchonis marker is adapted for placement over the ball, with the opening passing over the ball, rather than being placed slightly behind and under the rearward part of the ball. Cotchonis relies upon the sheer size of his marker for visibility, rather than providing any highly reflective means for visibility, as provided by the present marker. Also, the Cotchonis marker suffers from the same problem as other markers discussed further above, in that it has no protrusion to engage the surface, and may be moved some distance from its resting place if inadvertently kicked or stepped on by another player.

U.S. Pat. No. 4,822,052 issued to Gary S. Dimmick et al. on Apr. 18, 1989 describes a Golf Club Grip Attachment For Identification And Ball Position Marking. The attachment is primarily adapted to provide identification for the owner of the clubs, and is preferably permanently affixed to the ends of the club grips. However, the device which is secured to the putter includes a removable ball marker component. The marker component secures removably within the permanently affixed component on the end of the putter by means of a protruding snap fastener-like button in the center of the grip component, and a mating hole in the center of the removable marker component. Thus, the marker does not have any depending point or protrusion adapted to engage the green surface, and may be easily dislodged, as with other similar devices discussed further above. Also, no particularly high visibility is provided for the Dimmick et al. marker.

U.S. Pat. No. 5,282,616 issued to Marylou I. Stacavich-Notaro on Feb. 1, 1994 describes a Golf Ball Marker closely resembling the Sakuma device discussed further above, in that the '616 marker is removably secured to an underlying component by means of Velcro (tm) or the like. The underlying component may be removably pinned to a garment or the like, or may be permanently secured to the end of a golf putter or other club. The marker itself may include a downwardly extending pin to provide better security when placed on the green. While some identification means is disclosed, no particularly high visibility means is provided in the marker of the '616 patent.

U.S. Pat. No. D-319,862 issued to Torgny L. O. Lahger on Sep. 10, 1991 describes a design for Green Markers, comprising a disc with a pin protruding centrally therefrom. The pin has a larger diameter protuberance at the distal end thereof. No means of providing high visibility under different lighting angles, as provided by the present invention, is apparent in the Lahger ball markers.

U.S. Pat. No. D-348,402 issued to Thomas L. McDonald on Jul. 5, 1994 describes a design for a Combined Timepiece And Golfing Tool, comprising a pocket watch type timepiece secured to a double tined turf repair tool. The device would not be used as a ball marker, as it would project vertically from the surface if driven into the green. Even if positioned flat upon the surface, the indicated thickness of the timepiece in the side elevation view would preclude the unimpeded travel of a golf ball thereover.

British Patent Publication No. 664,172 to Jarrett, Rainsford, & Laughton Ltd. et al. and published on Jan. 2, 1952 describes Improvements In Or Relating To Tie Holders, Clips, Or Slides. The clip includes a removable button with an underlying collar adapted to be gripped within the clip. No centrally disposed downwardly extending protrusion adapted to engage a green, or highly reflective surface or other elements, are disclosed in the button element of the '172 British patent. A golfer would not be likely to wear a tie during play, making it unlikely that he or she would have such a clip, with its button, on their person during play. Thus, the button element is not readily adaptable as a ball marker.

British Patent Publication No. 2,049,438 to Masaru Watanabe and published on Dec. 31, 1980 describes a Marker For A Golf Ball, comprising a marker base having a downward extension therefrom adapted to secure to a mating apparel component. The base may have a figure or article therein, with a magnifying lens formed thereover. No particular reflectivity or brilliance is disclosed, as provided by the present marker, nor is any particular durability provided with a relatively soft plastic lens.

Finally, French Patent Publication No. 2,645,756 to Jean P. Angel and published on Oct. 19, 1990 describes an accessory for golfers comprising a forked turf repair tool including a ball marker removably attachable thereto. The marker has no particular distinguishing features, other than a circular inset element. No particular reflectivity or brilliance is disclosed in the French patent publication, nor is there any particular disclosure of durability of the marker itself (as opposed to the repair tool portion).

None of the above inventions and patents, taken either singly or in combination, is seen to describe the instant invention as claimed.

SUMMARY OF THE INVENTION

Accordingly, it is a principal object of the invention to provide an improved golf ball marker adapted for the temporary marking of the position of a golf ball during the game of golf.

It is another object of the invention to provide an improved marker which is also adapted as an article of high quality jewelry.

It is a further object of the invention to provide an improved marker which may be formed monolithically of a single element of precious metal, or alternatively formed of a plated base metal.

Another object of the present invention is to provide an improved marker which is highly durable and resistant to corrosion.

An additional object of the invention is to provide an improved marker which may include identification means, such as a name, initials, and/or other design, either in relief, engraved, or otherwise formed in the upper surface thereof.

Still another object of the invention is to provide an improved marker which may include one or more highly reflective precious stones disposed within settings from the upper surface.

Yet another object of the present invention is to provide a marker which may include a plurality of facets disposed about the upper periphery thereof, thereby providing high reflectivity and brilliance for the marker from any direction therefrom.

It is an object of the invention to provide improved elements and arrangements thereof in an apparatus for the purposes described which is of great value, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
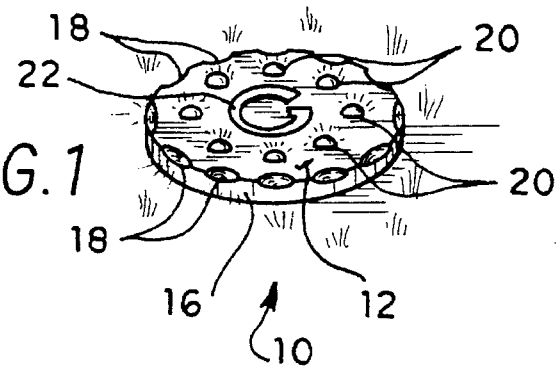
FIG. 1 is an environmental perspective view of the present golf ball marker shown positioned on a green or the like, and demonstrating the brilliant, highly reflective nature of the present marker.

The present invention comprises various embodiments of a golf ball marker, an example of which is shown in the environmental view of FIG. 1 as the marker 10. The present marker 10 comprises a generally flat plate monolithically formed of a durable solid metal selected for its value and resistance to corrosion and other adverse effects, such as gold, etc. Various gold alloys, such as ten, fourteen, and eighteen karat gold, have been found to work well in providing the required durability and resistance to corrosion desired for the present marker, but alternatively, other noble metals or alloys may be used as desired, such as platinum.

While the present marker 10 and its other embodiments comprise an ornamental piece of jewelry by means of various elements thereof, it will be seen that these jewelry elements provide some practical benefit for use as a golf ball marker. Due to the chemicals and fertilizers commonly used on golf courses, base metals which might be used in the construction of such a marker 10, would be likely to corrode relatively rapidly. The use of a noble metal, such as gold or an alloy thereof, precludes such corrosion, while also providing the brilliance and reflectivity desired to enable a golfer to locate his/her marker 10 rapidly when that golfer's ball is to be replaced. The use of such precious metals, as well as the brilliance provided by such when highly polished, provide a marker 10 which is also well suited for use as ornamental or decorative jewelry in addition to its marker function.

Figure 4:
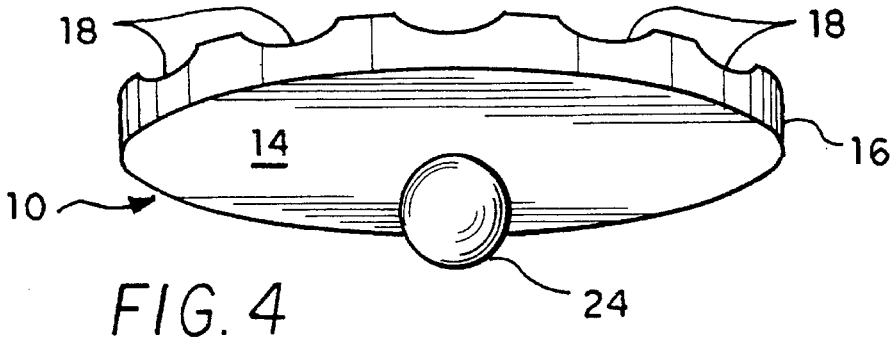
FIG. 4 is a bottom perspective view, showing the generally spherical protrusion extending from the bottom surface of the marker.

The present marker 10 is preferably formed as a generally circular flat plate, although other shapes may be used as desired. The plate has an upper surface 12 and an opposite lower surface 14 (shown in FIG. 4), which upper and lower surfaces 12 and 14 are preferably at least generally parallel to one another. The plate 10 has a periphery 16 defining the shape of the plate (e. g., circular, as shown), with the upper edge of the periphery 16 and the upper surface 12 having a plurality of beveled facets 18 formed therearound at the juncture of the periphery 16 and upper plate 12. These facets 18 are preferably flats cut or otherwise formed about the edge of the upper surface 12, but may be scalloped or otherwise curved, as desired. The facets 18 are polished to a high reflectivity, to provide brilliance and a sparkling appearance for the marker 10 as sunlight is reflected therefrom, regardless of the specific orientation of the sun relative to the marker 10.

Additional brilliance and sparkling reflectivity may be provided by polishing the upper surface 12 to a highly reflective finish, as in the marker 10 of FIG. 1, and/or by providing at least one (or a plurality, as shown in FIG. 1) of gems or other precious stones 20 set in the upper surface 12 of the marker 10. These gems or stones 20 may have a smoothly rounded polish, as is conventionally done for certain stones and as shown in FIG. 1, or may alternatively be faceted as is conventionally done with other types of stones (diamonds, etc.) as shown in the stones 20*a* of FIGS. 2 and 7. In either case, these stones 20/20*a* provide additional brilliance and reflectivity for the marker 10.

Some form of identification means may also be provided to individualize the present ball marker 10, if desired. In FIG. 1, a single alphabetic letter 22 is formed in the upper surface 12 of the marker 10, i. e., an initial of the owner, etc. It will be understood that while a block letter is shown, other styles (italicized, script, etc.) may be used as desired, and that such letters are not limited to the Roman alphabet, but may be in the form of any characters and/or symbols as desired.

Figure 2:
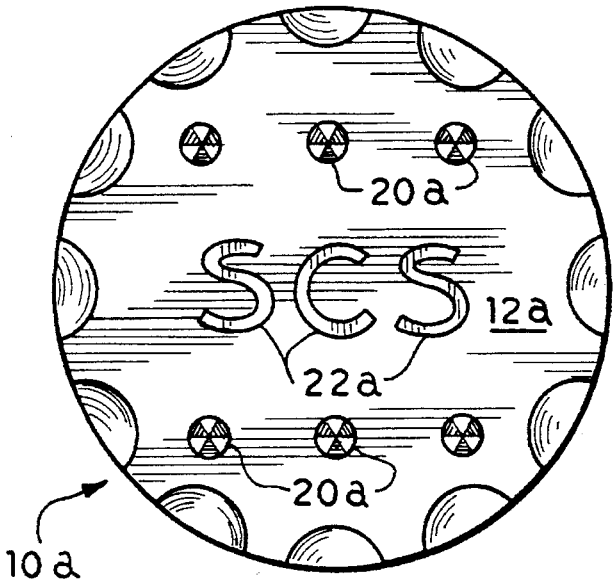
FIG. 2 is a top plan view of one embodiment of the present marker, showing its highly reflective upper surface and facets, precious stones, and identification means thereon.
Figure 3:
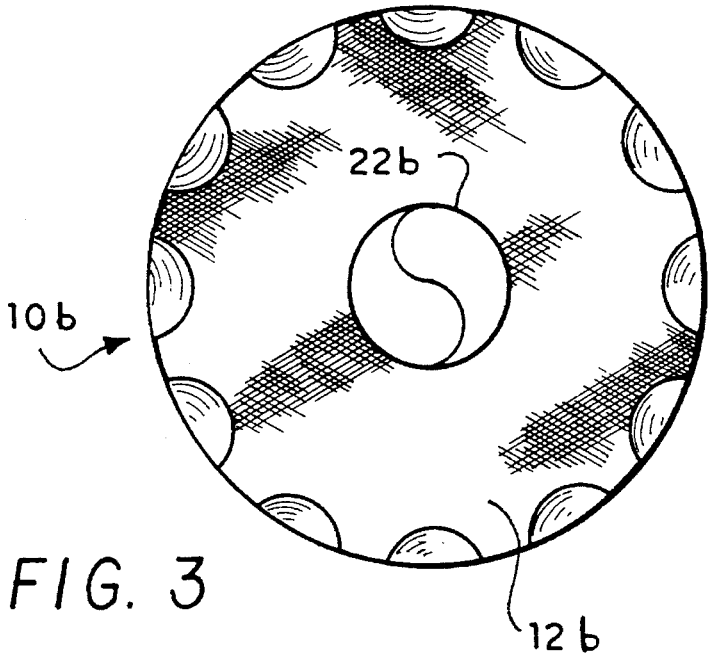
FIG. 3 is a top plan view of an alternative embodiment of the present marker, showing a florentine finish thereon with its faceted upper periphery, with alternative identification means.

Another example of the above is shown in FIG. 2, where a series of three initials 22*a* in the form of a monogram, etc. are provided in or on the upper surface 12*a* of the marker 10*a*. FIG. 3 shows yet another alternative, with a design symbol or logo 22*b* being displayed. It will also be noted that the upper surface 12*b* of the marker 10*b* of FIG. 3 has a florentine finish, formed of an innumerable series of fine lines crossing the surface. Other types of finishes, either matte or polished, may be provided as desired, depending upon the tastes and desires of the owner or user. While such a florentine or other matte finish may not provide the brilliance and reflectivity of a highly polished surface, it will be seen that other brilliance means, such as the facets 18 and/or gem stones 20/20*a* as in FIGS. 1 and 2, may be provided in order to produce the desired brilliance and reflectivity to enable the present marker 10*b* to be seen readily upon a golf green, when replacement of the ball is desired.

Figure 5:
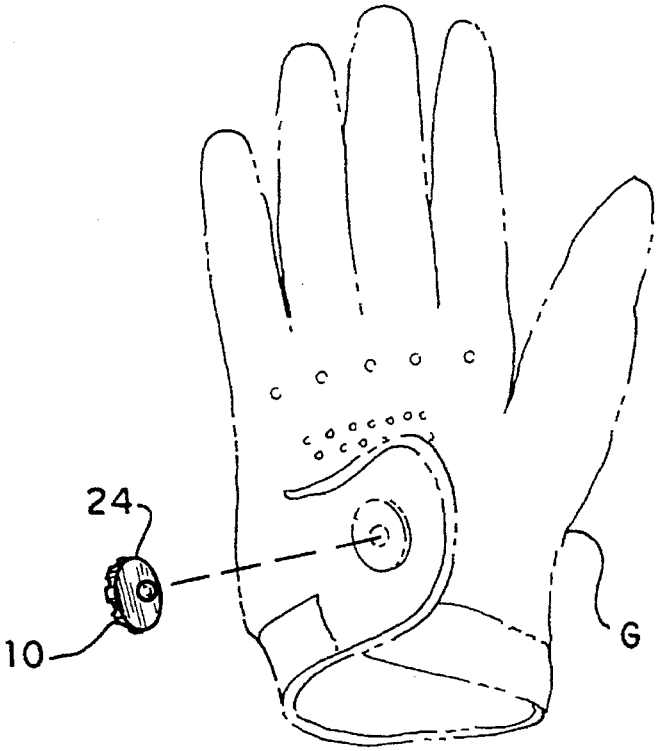
FIG. 5 is an exploded perspective view of the present marker, showing its removable installation on an article of apparel by means of the spherical projection on the bottom of the marker.

Another feature of the present marker 10, and its other embodiments, is the provision of a generally spherical projection or stud 24 depending generally centrally from the lower surface 14, as shown in FIGS. 4 through 7 of the drawings. This stud 24 serves at least two functions for the present ball marker 10 and its various embodiments: First, since the present marker 10 and embodiments thereof comprises an attractive article of jewelry, the stud 24 enables the marker 10 to be secured to an article of clothing or apparel, e.g., to the cuff of a golf glove G as shown in FIG. 5. The stud 24 is also well adapted to secure the marker 10 in a lapel button hole or other suitable location on the apparel of the wearer. Secondly, the stud 24 projects downwardly into the grass of the green when the marker 10 is placed thereon, to assist in securing the marker 10 at that particular point on the green and to reduce the likelihood of the marker 10 being inadvertently displaced by another golfer stepping on it, or by a ball rolling over it.

Figure 6:
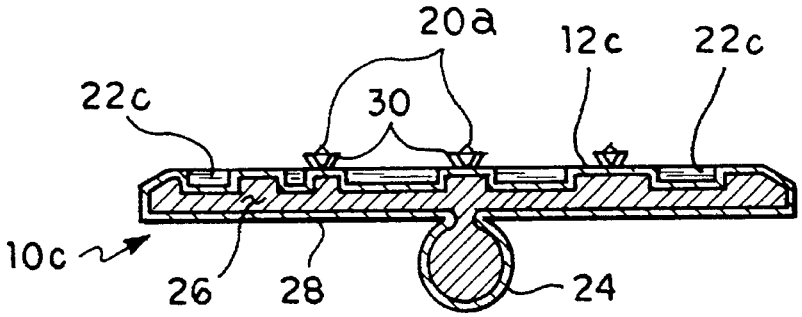
FIG. 6 is an elevation view in section of an alternative embodiment of the present marker, showing a central base metal construction with a precious metal plating entirely thereover, and an engraved identification disposed in the upper surface thereof.
Figure 7:
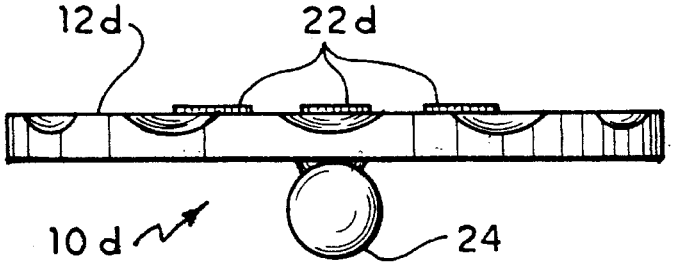
FIG. 7 is an elevation view of the present marker, showing an alternative raised pattern from the upper surface thereof.

FIGS. 6 and 7 respectively provide an elevation view in section and an external elevation view of additional embodiments of the present marker. In FIG. 6, a marker 10*c* is provided which has a core 26 of relatively inexpensive base metal, but which has a noble metal plating 28 (gold, platinum, etc.) thereover. While such a relatively inexpensive plated marker 10*c* may not be desirable as a primary embodiment of the present invention, it provides an alternative for those who may not wish to use a marker formed purely of a costly element.

It will also be noted that the indicia 22*c* formed in the upper surface 12*c* of the marker 10*c* of FIG. 6, are engraved or inset below the remainder of the surface 12*c*, as is clearly indicated in the elevation view in section of FIG. 6. The precious stones 20*a* of the FIG. 6 marker 10*c* are disposed in settings 30 above the upper surface 12*c*, so as to catch the maximum amount of light and to provide exceptional brilliance.

The marker 10*d* of FIG. 7 shows an alternative arrangement, wherein the indicia 22*d* is raised in relief above the surface 12*d*. Also, while no precious stones are shown with the ball marker 10*d* of FIG. 7, it will be understood that one or more precious stones, either rounded as with the stones 20 of FIG. 1 or faceted as with the stones 20*a* of FIGS. 2 and 6, may be provided in any combination desired on the marker 10*d* of FIG. 7, or any of the other markers included by the present golf ball marker invention.

The present marker, in keeping with its function as a ball marker and also as an attractive article of jewelry, is relatively small, being on the order of from 3 millimeters to 20 millimeters in diameter (approximately one eighth inch to three quarters of an inch in diameter). The thickness preferably ranges from 0.3 millimeter to 5 millimeters, with the thinner dimensions accompanying the smaller diameters of the present marker in its various embodiments. Such small sizes provide an understated, yet elegant, article of jewelry, with the brilliance and reflectivity provided by the highly polished facets and stones, providing for ease of location of the present marker when used on a golf green.

The gem stones used in the present marker need not be of large size, in keeping with the relatively small diameter of the marker itself. Preferably, such stones are relatively small, in order that the remainder of the marker not be overwhelmed by such stones. It has been found that stones (particularly diamonds and similar gem stones) of from one to five points are particularly attractive in consideration of the size of the present marker. Such stones may be birth stones (diamond, emeralds, rubies, opals, etc.) or other reflective and attractive gems, as desired, and may comprise a single stone centered on the marker, or plural stones along the periphery and/or disposed on the monogram or other identification means on the upper surface, as desired.

In summary, the present golf ball marker will be seen to provide dual functionality, in that it serves as a very useful ball marker in the game of golf, due to its highly reflective and brilliant elements, individualized indicia, and durability and resistance to corrosion, and also serves well as an ornamental article of jewelry, by means of the precious and noble metals and precious gems which may be used in its manufacture. While lesser metals may be used as a base, with a precious metal plating, the present marker is preferably a premium quality article which provides the owner thereof with distinction both as an ornament and also on the golf course.

It is to be understood that the present invention is not limited to the sole embodiments described above, but encompasses any and all embodiments within the scope of the following claims.

I claim:

1. A golf ball marker adapted for temporary placement on a golf green to mark the location of a golf ball temporarily removed therefrom, said marker comprising:

a generally flat plate having an upper surface and an opposite lower surface generally parallel to said upper surface, with said lower surface having a generally spherical stud generally centered thereon and projecting downwardly therefrom, with said marker comprising said plate and said stud being monolithically formed of durable solid metal, and;

said plate having a periphery with an upper edge joining said upper surface, with said upper surface and said upper edge of said periphery including a plurality of beveled and highly polished and reflective facets formed completely therearound to provide brilliance means for said marker, whereby;

said marker is adapted for removable attachment to golfing apparel by said stud and is removably placeable on a golf green for the temporary marking of a golf ball removed from play with said stud further serving to secure said marker upon the green, and with said marker further adapted to be easily located on the green by said highly reflective facets and brilliance means.

2. The golf ball marker according to claim 1, wherein:

said plate is substantially circular.

3. The golf ball marker according to claim 2, wherein:

said plate has a diameter of between three millimeters and twenty millimeters, inclusive.

4. The golf ball marker according to claim 1, wherein:

said marker is formed of solid gold selected from the group consisting of ten karat, fourteen karat, and eighteen karat gold.

5. The golf ball marker according to claim 1, wherein:

said marker is formed of solid platinum.

6. The golf ball marker according to claim 1, wherein:

said marker is formed of a base metal plated with a precious metal.

7. The golf ball marker according to claim 1, wherein:

said upper surface of said plate is highly polished and reflective to provide additional brilliance means for said marker.

8. The golf ball marker according to claim 1, wherein:

said upper surface of said plate includes a florentine finish thereon.

9. The golf ball marker according to claim 1, including:

engraved indicia formed in said upper surface.

10. The golf ball marker according to claim 1, including:

relief indicia formed upon said upper surface.

11. A golf ball marker adapted for temporary placement on a golf green to mark the location of a golf ball temporarily removed therefrom, said marker comprising:

a generally flat plate having an upper surface and an opposite lower surface generally parallel to said upper surface, with said lower surface having a generally spherical stud generally centered thereon and projecting downwardly therefrom, with said marker comprising said plate and said stud being monolithically formed of durable solid metal;

said plate having a periphery with an upper edge joining said upper surface, with said upper surface and said upper edge of said periphery including a plurality of beveled and highly polished and reflective facets formed completely therearound to provide brilliance means for said marker, and;

said marker including at least one gem stone and setting therefor disposed upon said upper surface of said plate to provide additional brilliance means for said marker, whereby;

said marker is adapted for removable attachment to golfing apparel by said stud and is removably placeable on a golf green for the temporary marking of a golf ball removed from play with said stud further serving to secure said marker upon the green, and with said marker further adapted to be easily located on the green by said highly reflective facets and gem stone brilliance means.

12. The golf ball marker according to claim 11, wherein:

said plate is substantially circular.

13. The golf ball marker according to claim 12, wherein:

said plate has a diameter of between three millimeters and twenty millimeters, inclusive.

14. The golf ball marker according to claim 11, wherein:

said marker is formed of solid gold selected from the group consisting of ten karat, fourteen karat, and eighteen karat gold.

15. The golf ball marker according to claim 11, wherein:

said marker is formed of solid platinum.

16. The golf ball marker according to claim 11, wherein:

said marker is formed of a base metal plated with a precious metal.

17. The golf ball marker according to claim 11, wherein:

said upper surface of said plate is highly polished and reflective to provide additional brilliance means for said marker.

18. The golf ball marker according to claim 11, wherein:

said upper surface of said plate includes a florentine finish thereon.

19. The golf ball marker according to claim 11, including:

engraved indicia formed in said upper surface.

20. The golf ball marker according to claim 11, including:

relief indicia formed upon said upper surface.

* * * * *